United States Patent [19]

Claar et al.

[11] 4,142,841

[45] Mar. 6, 1979

[54] VARIABLE DISPLACEMENT PUMP CONTROL

[75] Inventors: Leslie M. Claar, Willowick; Raymond E. Johnson, Newbury, both of Ohio

[73] Assignee: Parker-Hannifin Corporation, Cleveland, Ohio

[21] Appl. No.: 829,216

[22] Filed: Aug. 31, 1977

[51] Int. Cl.[2] ..... F04B 49/00; F04B 1/30

[52] U.S. Cl. ..... 417/213

[58] Field of Search ..... 417/222, 212, 213, 218, 417/299; 60/445, 427

[56] References Cited

U.S. PATENT DOCUMENTS

| | | | |
|---|---|---|---|
| 3,082,693 | 3/1963 | Budzich | 417/299 |
| 3,512,178 | 5/1976 | Russell | 417/218 |
| 3,726,093 | 4/1973 | Malott | 60/445 |
| 3,866,419 | 2/1975 | Paul | 60/427 |
| 3,908,519 | 9/1975 | Born et al. | 417/217 |
| 3,941,513 | 3/1976 | Malott | 417/212 |
| 3,945,764 | 3/1976 | Marietta | 417/212 |
| 3,948,147 | 4/1976 | Schweiberdingen | 417/299 |

*Primary Examiner*—William L. Freeh

*Attorney, Agent, or Firm*—Maky, Renner, Otto & Boisselle

[57] ABSTRACT

A variable displacement pump control having, in addition to a pressure compensator (with or without an auxiliary modulator), a multi-purpose valve which is open at pump startup to purge air therefrom, which is automatically closed after purging of the air, and which is opened in the manner of a relief valve responsive to a sudden rise in pump discharge pressure caused as by rapid closing of a directional control valve. The control is further characterized in that the pressure compensating pilot valve also constitutes a pilot valve for the multi-purpose valve to permit opening of a relief passage by the latter when pump discharge pressure suddenly rises.

24 Claims, 3 Drawing Figures

18
19
17
17
15
20
20
16
9
6
16
-5-
1
3
4
2
7
8
25
28
29
11
57
3
3
2
2
16
12
-10-
27
49
26
48
23
31
14
37
21
16
16

10
28
49
48
47
27
38
39
37
35
62
34
36
A
51
24
31
32
50
40
-12-
30
23
43
42
45
41
46
26
16

10
62
12
55
25
63
58
60
57
16
56
59
61

VARIABLE DISPLACEMENT PUMP CONTROL

BACKGROUND OF THE INVENTION

A variable displacement pump control as for an axial piston pump having a swash plate actuating piston generally provides for pressure compensation with or without auxiliary modulation to control the fluid pressure applied to the swash plate actuating piston to maintain a predetermined pressure drop across a variable area metering orifice embodied as in a directional control valve for a fluid motor. The following U.S. patents exemplify variable displacement pump controls including pressure compensation with or without auxiliary modulation; U.S. Pat. Nos.

3,512,178, May 12, 1970, Russell;
3,726,093, Apr. 10, 1973, Malott;
3,866,419, Feb. 18, 1975, Paul;
3,941,513, Mar. 2, 1976, Malott;
3,945,764, Mar. 23, 1976, Marietta.

Variable displacement pumps of the character indicated are often employed in conjunction with hydraulic systems including one or more directional control valves for controlling the operation of a corresponding number of fluid motors, and in existing controls, air may be introduced into the hydraulic system upon pump startup if there is air in the pump or in the intake line thereof. Moreover, in existing controls, the pump may be subject to pressure peaks or spikes of high intensity due to, for example, rapid closing of a directional control valve.

In the U.S. Pat. Nos. 3,941,513 and 3,945,764, a constant pressure pilot valve controls a modulator which bleeds off pressure acting on the swash plate actuating piston, thus to provide the pressure compensation feature and the modulator, in addition, has opposed areas exposed respectively to pressures upstream and downstream of a variable area orifice to maintain a predetermined pressure drop across said variable area orifice, whereby if the pressure drop exceeds the predetermined pressure drop, the modulator bleeds off the pressure acting on the swash plate actuating piston to effect decrease in pump displacement. In the event of malfunction of the modulator, such as sticking thereof, the pump may be overloaded even if a horsepower modulator is provided as contemplated in said U.S. Pat. Nos. 3,941,513 and 3,945,764.

SUMMARY OF THE INVENTION

A variable displacement pump control having, in addition to a pressure compensating modulator controlled by a pilot valve (with or without an auxiliary modulator), a normally open valve in communication with the discharge port of the pump through which air in the pump and its intake line is purged to the low pressure zone or reservoir upon pump startup, and which is actuated to closed position by buildup of oil pressure in the pump discharge. Said valve also functions as a relief valve under the control of the pressure compensating pilot valve to limit pressure peaks or spikes caused as by sudden blockage of the pump discharge line by rapid closing of a directional control valve or at the end of the stroke of a fluid motor controlled by the directional control valve.

DETAILED DESCRIPTION OF THE INVENTION

Figure 1:
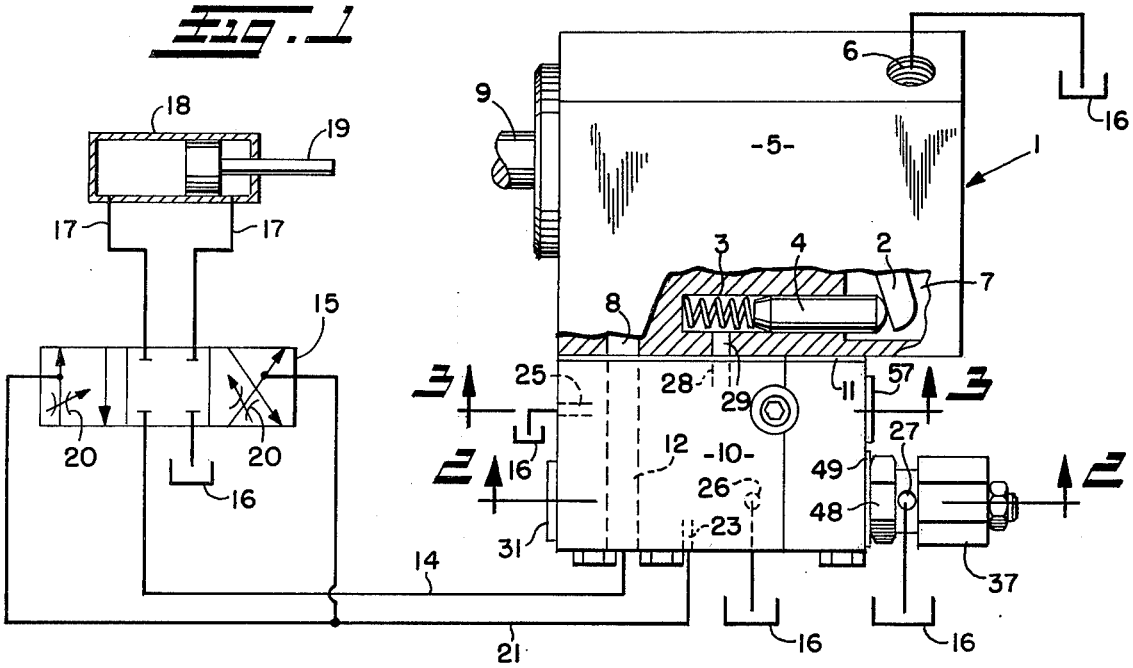
FIG. 1 is a plan view showing the variable displacement pump control herein secured to the pump housing and operatively associated with a directional control valve and a fluid motor.

The variable displacement pump 1 herein shown by way of illustrative example, may be an axial piston pump such as that shown in Malott U.S. Pat. No. 3,726,093 granted Apr. 10, 1973 in which the displacement is varied by changing the angular position of the swash plate 2, such change in swash plate angle being hydraulically effected by control of fluid pressure in the bore 3 in which the swash plate actuating piston 4 is axially movable. The pump housing 5 has an intake port 6 leading into the intake chamber 7 and has an outlet or discharge port 8 from which fluid is delivered under pressure upon driving of the drive shaft 9 which is journaled in the pump housing 5 in well known manner.

Bolted or otherwise secured to the pump housing 5 is the valve housing 10 for a valve assembly which provides for pressure compensation and auxiliary modulation of the pump 1, which provides for purging of air from the pump 1 upon start-up thereof, and which provides for relief of excess oil pressure to limit pressure peaks or spikes or to prevent pump overloading in the event of malfunction of the pressure compensating and auxiliary modulator. A suitable gasket 11 seals the joint between the valve housing 10 and the pump housing 5.

The valve housing 10 has a high pressure passage 12 therethrough, which at one end communicates with the pump discharge port 8 and which at the other end is connected by the conduit 14 to the inlet port of a directional control valve 15. The return port of the directional control valve 15 is communicated in well-known manner with a suitable tank or reservoir 16. The motor ports of the directional control valve 15 are connected by conduits 17; 17 to a fluid motor 18 and, as evident, the directional control valve 15 is operative to selectively actuate the piston 19 of the fluid motor 18 in opposite directions. The directional control valve 15 is preferably of the type which provides a variable area orifice 20 which varies in size according to the extent of movement of the valve member of the directional control valve 15, thus to control the speed of actuation of the fluid motor 18. The fluid pressure downstream of the variable area orifice 20 is conducted by the conduit 21 to the sensing passage 23 in the valve housing 10 and, as hereinafter explained in detail, an auxiliary modulator 24 in the valve housing 10 senses the pressure drop across the orifice 20 and varies the pressure in bore 3 acting on the swash plate actuating piston 4 to achieve the selected flow rate by maintaining a substantially constant pressure drop across the variable area orifice 20 independently of load pressure of the fluid motor 18.

The valve housing 10 is disposed in the pump transmission housing (designated as reservoir 16) and thus the oil return passages 25, 26, and 27 in the housing 10 need not have conduits connected thereto, but simply open into the transmission housing as shown. The valve housing 10 also has a passage 28 which registers with a passage 29 in the pump housing 5 leading into the bore 3 in which the swash plate actuating piston 4 is reciprocable.

Figure 2:
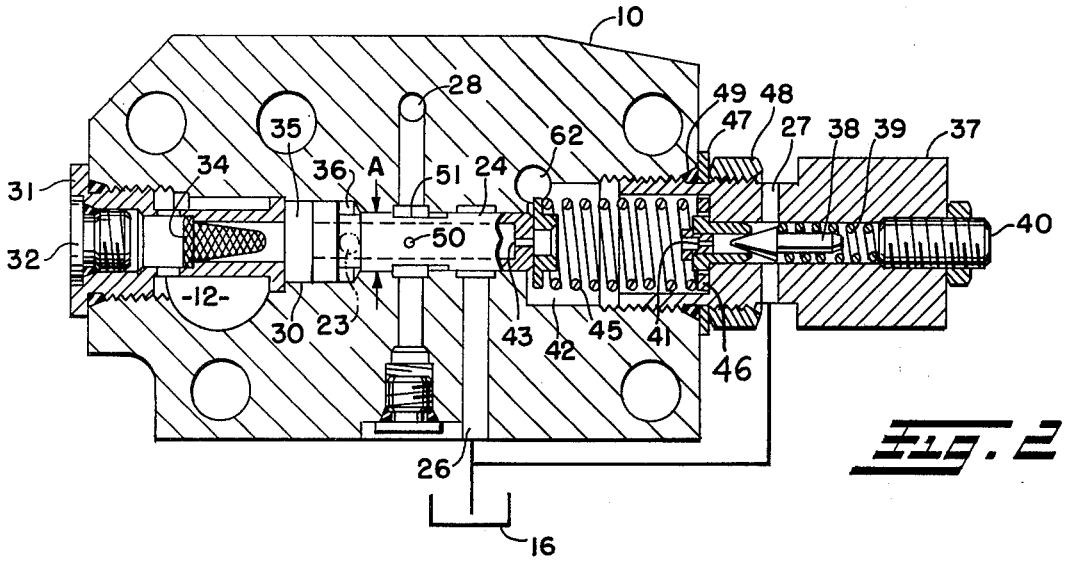
FIGS. 2 and 3 are cross-section views on somewhat enlarged scale taken substantially along the lines 2—2 and 3—3 of FIG. 1.

Referring now in detail to FIG. 2, the high pressure passage 12 is intersected by a stepped bore 30 which is closed at one end by the fitting 31 and plug 32, the fitting 31 carrying a filter 34 and providing a passage which intercommunicates the high pressure passage 12 with a chamber 35. Slidable in the bore 30 is the auxiliary modulator 24 which may be in the form of a valve spool as shown, and which defines a chamber 36 to which the low signal pressure from the downstream side of the variable area orifice 20 is conducted by conduit 21 and passage 23 as previously mentioned.

Screwed into the other end of the bore 30 is a pilot valve body 37, having a seat for a constant pressure pilot valve 38 which is biased by the spring 39 to seat-engaging position. The biasing force of the spring 39 may be adjusted by the adjusting screw 40. Upstream of the seat is an orifice 41. The pilot valve body 37, defines with the valve housing 10 a chamber 42 which has communication with the high pressure chamber 35 via the orifice 43 in the modulator 24. A spring 45 in said chamber 42 biases the modulator 24 to the position shown in FIG. 2, the biasing force of said spring 45 being adjusted to desired value as by substituting a washer 46 of different thickness and preferably the connection of the pilot valve body 37 to the valve housing 10 is such that the pilot valve body 37 may be unscrewed as much as say one full turn, while yet the washer 47 on the groove of the pilot valve body 37 may be tightly clamped against the valve housing 10 by the lock nut 48 to retain the O-ring 49 in sealed engagement with housing 10 and body 37.

The modulator 24 has an orifice 50 which communicates the high pressure chamber 35 by way of passages 28 and 29 with the bore 3 in which the swash plate piston 4 is receiprocable. The modulator 24 also has bleed passages 51 for bleeding fluid pressure in the bore 3 to exhaust passage 26 to decrease the fluid pressure in the bore 3 thus to permit the swash plate actuating piston 4 and swash plate 2 to move in displacement decreasing direction when the modulator 24 moves against spring 45 to open the bleed passages 51 to the exhaust passage 26.

When the pilot valve 38 is closed, the fluid pressures in the chambers 35 and 42 acting on area A are equalized through the modulator orifice 43 whereby the swash plate actuating piston 4 is exposed to fluid pressure through the orifice 50 equal to that in the discharge passage 12 and chamber 35 so long as the pressure drop across the variable area orifice 20 is of predetermined value acting on opposite annular areas of the chambers 35 and 36 of the modulator 24.

Should the pressure drop across the variable area orifice 20 increase, due to increased flow above that for which the directional control valve 15 has been actuated, the increased differential of pressure acting on the annular areas of the modulator chambers 35 and 36 will urge the modulator 24 in a direction to compress the spring 45 and to meter fluid from bore 3 through the bleed passages 51 thus to decrease the fluid pressure acting on the piston 4 to permit shifting of the swash plate 2 to pump displacement decreasing direction until the pressure drop across the variable area orifice 20 reaches a predetermined value such that the spring 45 will urge the modulator 24 to a position closing the bleed passage 51.

With reference to pressure compensation, when the pressure in the chamber 42 reaches a value sufficient to open the pilot valve 38, the chamber 42 will be communicated with the exhaust passage 27 via the orifice 41 and the open pilot valve 38, and the modulator orifice 43 will cause a drop in pressure in the chamber 42 with respect to the pressure in the chamber 35, whereby the modulator 24 will again move to compress the spring 45 to open the bleed passages 51 to bleed off pressure acting on the piston 4 with consequent movement of swash plate 2 in displacement decreasing direction. Should it be desired to have pressure compensation without auxiliary modulation, the passage 23 in the valve housing 10 may be plugged whereby the modulator 24 will move to bleed off position responsive to opening of the pilot valve 38.

Figure 3:
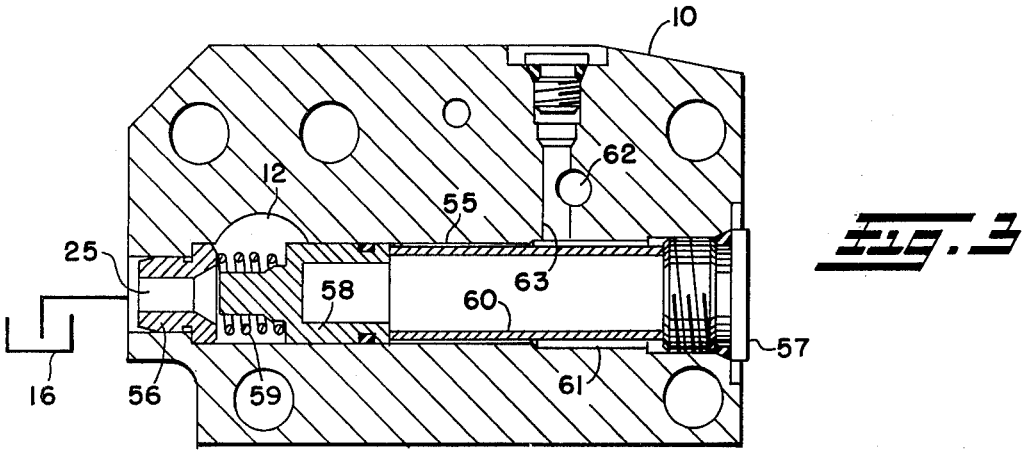

Referring now to FIG. 3 the valve housing 10 has another bore 55 which intersects the high pressure discharge passage 12, one end of said bore 55 having a seat member 56 therein which provides the exhaust or relief passage 25 opening into the high pressure discharge passage 12. The other end of the bore 55 is closed by the plug 57. Slidably sealed in the portion of the bore 55 adjacent its intersection with the high pressure discharge passage 12 is a valve member 58 which is biased by the spring 59 to a normally open position communicating the high pressure discharge passage 12 with the exhaust passage 25. A spacer sleeve 60 between the plug 57 and the valve member 58 limits the movement of the valve member 58 in its open direction. The valve member bore 55 and plug 57 define a chamber 61 which is in communication with the pilot valve chamber 42 by way of the valve housing passages 62 and 63.

As will now be described, the valve member 58 is both an air purging valve and a relief valve. When the pump 1 is started if there is air in the pump or its intake line, the air will be purged through the passages 12 and 25, because the pressure differential across the open valve member 58 is insufficient to compress the spring 59 for movement of the valve member 58 into engagement with the seat member 56. However, as soon as the air has been purged, the oil flow will cause a pressure drop at the valve member 58 in relation to the pressure which acts in the chamber 61 via the pilot valve chamber 42 and the modulator orifice 43. Moreover, the pressure in chamber 61 acts on a larger area of the valve member 58 so that once the valve member 58 is in seated position, equal pressures on opposite sides of the valve member 58 will retain it in seated position during normal operation of the pump 1 and the pressure compensating and auxiliary modulation movements of the modulator 24. Accordingly, the valve member 58 will be retained in seated position during increase or decrease of pump capacity by movements of the modulator 24 owing to pressure differentials in the chambers 35 and 36 or chambers 35 and 42 responsive to opening and closing of the pilot valve 38. In normal operation, when the pilot valve 38 opens the pressure drop across the orifice 41 and orifice 43 is such that the pilot chamber pressure 42 will not decrease sufficiently to permit the spring 59 and pressure acting on the smaller annular area of the valve member 58 to open the valve member 58.

However, if the discharge line 14 is suddenly blocked as by rapid shifting of the directional control valve 15 from operating position to neutral position, or upon the piston 19 reaching the end of its stroke while the directional control valve 15 remains in operating position, there will be a high pressure peak or spike which will cause opening of the pilot valve 38, and the corresponding increased pressure drop across the orifice 43 will reduce the pressure in the chamber 42 and in the valve chamber 61 so that the high pressure acting on the valve member 58 together with the biasing force of the spring 59 will open the valve member 58 in the manner of a relief valve to communicate the high pressure discharge passage 12 with the exhaust or relief passage 25 thus to limit the pressure peak or spike. Without this relief valve feature, the pump 1 may be operating under extremely high pressure until it has time to destroke, such destroking time generally being quite long owing to the slow gradual operation of the modulator 24 in normal circumstances.

Another feature of the valve member 58 is that should the modulator 24 malfunction as by sticking in the stepped bore 30, the rising pressure while sufficient to open the pilot valve 38 will be continued to be applied on the swash plate actuating piston 4 through the orifice 50 with possibility of overloading of the pump 1. However, in the present case, when the pilot valve 38 opens, the pressure drop in the chamber 42 will permit opening of the valve member 58 to quickly relieve the high pressure discharge passage 12 whereby the pressure in the bore 3 will bleed through the modulator orifice 50 to permit destroking of the pump 1.

In summary therefore, the variable displacement pump control herein has a dual purpose air purging-relief valve 58 which is operatively associated with the pressure compensating and auxiliary modulation features of the control so that said dual purpose valve 58 allows purging of air from the pump 1 and its intake line upon pump startup and constitutes a relief valve under the control of the pressure compensating pilot valve 38 to limit pressure peaks in the pump discharge 12 due, as, for example, by rapid closing of a directional control valve 15 and also as a relief valve should the auxiliary modulator 24 be malfunctioning.

The embodiments of the invention in which an exclusive property or privilege is claimed are defined as follows:

1. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; and another valve member movable in said housing assembly responsive to opening of said pilot valve and to abnormal increase in pressure drop across said orifice means to open a relief passage from said high pressure zone to said low pressure zone; said another valve member when in relief passage closing position having unequal opposed areas of which the smaller area is exposed to said high pressure zone and of which the larger area is exposed to said high pressure zone via said orifice means.

2. The control means of claim 1 wherein spring means acting on said another valve member assists the fluid pressure acting on said smaller area in moving said another valve member to open said relief passage as aforesaid.

3. The control means of claim 2 wherein said relief passage is open during start-up of said pump means to purge air from said pump means and is closed by said another valve member as fluid pressure commences to build up following such purging of air.

4. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; and another valve member movable in said housing assembly responsive to opening of said pilot valve and to abnormal increase in pressure drop across said orifice means to open a relief passage from said high pressure zone to said low pressure zone; and another orifice means limiting the pressure drop across said orifice means during normal operation of said valve and pilot valve members so that said another valve member is retained in position closing said relief passage except when there is an abnormal increase in pressure drop across said orifice means due to rapid rise of fluid pressure in said high pressure zone; said another valve member having opposed areas respectively exposed to said high pressure zone and to said high pressure zone between said orifice means and said another orifice means.

5. The control means of claim 4 wherein the opposed areas of said another valve member are unequal, the smaller area being exposed to said high pressure zone and the larger area being exposed to said high pressure zone between said orifice means and said another orifice means.

6. The control means of claim 5 wherein spring means acting on said another valve member assists the fluid pressure acting on said smaller area in moving said another valve member to open said relief passage as aforesaid.

7. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; and another valve member movable in said housing assembly responsive to opening of said pilot valve and to abnormal increase in pressure drop across said orifice means to open a relief passage from said high pressure zone to said low pressure zone; said housing assembly comprising a pump housing having an intake port adapted to be communicated with a fluid reservoir, a discharge port, and an adjustment port leading to said fluid pressure operated member; and a valve housing secured to said pump housing and provided with discharge and adjustment passages registering with said discharge and adjustment ports; said valve housing having first and second bores intersecting said discharge passage and respectively containing said valve and pilot valve members and said another valve member and providing such restricted communication between said discharge and adjustment passages and providing openings for reservoir discharge from said bleed and relief passages and from said pilot valve member.

8. The control means of claim 7 wherein said another valve member has opposed areas respectively exposed to fluid pressure in said discharge passage and to fluid pressure downstream of said orifice means via a valve housing passage intercommunicating said first and second bores.

9. The control means of claim 7 wherein said another valve member has unequal opposed areas of which the smaller area is exposed to fluid pressure in said discharge passage and of which the larger area is exposed to fluid pressure downstream of said orifice means via a valve housing passage intercommunicating said first and second bores.

10. The control means of claim 9 wherein spring means acting on said another valve member assists the pressure acting on said smaller area in moving said another valve member to open said relief passage as aforesaid.

11. A control means for a variable displacement hydraulic pump of the type which includes a housing assembly having a pressure chamber to which fluid pressure from the high pressure zone of said pump is conducted by way of a restricted passage to act on a pump displacement varying means in said chamber; said control means comprising a pilot operated valve assembly in said housing assembly having a pilot valve member which opens and closes communication between the high and low pressure zones of said pump responsive to the fluid pressure in said high pressure zone being greater than or less than predetermined magnitude, and a spring biased main valve member having first opposed areas respectively exposed to said high pressure zone and to said high pressure zone via orifice means, said main valve member being moved to open a bleed passage from said chamber to said low pressure zone when said pilot valve member is open and to close said bleed passage when said pilot valve is closed, said bleed passage when open decreasing the fluid pressure in said chamber for movement of said pump displacement varying means to decrease the displacement of said pump; and another valve member movable in said housing assembly responsive to opening of said pilot valve and to abnormal increase in pressure drop across said orifice means to open a relief passage from said high pressure zone to said low pressure zone; said another valve member having unequal opposed areas of which the smaller area is exposed to said high pressure zone and of which the larger area is exposed to said high pressure zone via said orifice means.

12. The control means of claim 11 wherein spring means acting on said another valve member assists the fluid pressure acting on said smaller area in moving said another valve member to open said relief passage as aforesaid.

13. The control means of claim 12 wherein said another valve member, upon start-up of said pump, purges air therefrom through said relief passage until fluid pressure builds up to actuate said another valve member to overcome said spring means to close said relief passage.

14. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid said one side of said valve member is effective to move it to a position to open said bleed passage for movement of said fluid pressure operated member to decrease the capacity of said pump means; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone, said valve member, while said pilot valve is closed, being moved to bleed passage opening position against said spring means when the fluid pressure differential acting on said second opposed areas exceeds a predetermined value; and another valve member movable in said housing assembly responsive to opening of said pilot valve and to abnormal increase in pressure drop across said orifice means to open a relief passage from said high pressure zone to said low pressure zone; said another valve member having unequal opposed areas of which the smaller area is exposed to said high pressure zone and of which the larger area is exposed to said high pressure zone via said orifice means.

15. The control means of claim 14 wherein spring means acting on said another valve member assists the pressure acting on said smaller area in moving said another valve member to open said relief passage as aforesaid.

16. Control means for a variable displacement hydraulic pump of the type including a housing assembly having pump means, high and low fluid pressure zones, and a fluid pressure operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone, said valve member, while said pilot valve is closed, being moved to bleed passage opening position against said spring means when the fluid pressure differential acting on said second opposed areas exceeds a predetermined value; and another valve member movable in said housing assembly responsive to opening of said pilot valve and to abnormal increase in pressure drop across said orifice means to open a relief passage from said high pressure zone to said low pressure zone; said housing assembly comprising a pump housing having an intake port adapted to be communicated with a fluid reservoir, a discharge port, and an adjustment port leading to said fluid pressure operated member; and a valve housing secured to said pump housing and provided with discharge and adjustment passages registering with said discharge and adjustment ports; said valve housing having first and second bores intersecting said discharge passage and respectively containing said valve and pilot valve members and said another valve member and providing such restricted communication between said discharge and adjustment passages and providing a sensing passage opening and openings for reservoir discharge from said bleed and relief passages and from said pilot valve.

17. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone, said valve member, while said pilot valve is closed, being moved to bleed passage opening position against said spring means when the fluid pressure differential acting on said second opposed areas exceeds a predetermined value; and another valve member movable in said housing assembly responsive to opening of said pilot valve and to abnormal increase in pressure drop across said orifice means to open a relief passage from said high pressure zone to said low pressure zone; said another valve member having opposed areas respectively exposed to said high pressure zone and to said high pressure zone via said orifice means.

18. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone, said valve member, while said pilot valve is closed, being moved to bleed passage opening position against said spring means when the fluid pressure differential acting on said second opposed areas exceeds a predetermined value; and another valve member movable in said housing assembly responsive to opening of said pilot valve and to abnormal increase in pressure drop across said orifice means to open a relief passage from said high pressure zone to said low pressure zone; said another valve member when in relief passage closing position having unequal opposed areas of which the smaller area is exposed to said high pressure zone and of which the larger area is exposed to said high pressure zone via said orifice means.

19. The control means of claim 18 wherein spring means acting on said another valve member assists the fluid pressure acting on said smaller area in moving said another valve member to open said relief passage as aforesaid.

20. The control means of claim 19 wherein said relief passage is open during start-up of said pump means to purge air from said pump means and is closed by said another valve member as fluid pressure commences to build up following such purging of air.

21. Control means for a variable displacement hydraulic pump of the type including a housing assembly having pump means, high and low fluid pressure zones, and a fluid pressure operated member operatively engaged with said pump means to vary the displacement thereof, said fluid pressure operated member having restricted fluid communication with said high pressure zone; said control means comprising a valve member movable in said housing assembly to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing assembly biasing said valve member to bleed passage closing position; and a pilot valve in said housing assembly opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move it to a position to open said bleed passage for movement of said fluid pressure operated member to decrease the capacity of said pump means; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone, said valve member, while said pilot valve is closed, being moved to bleed passage opening position against said spring means when the fluid pressure differential acting on said second opposed areas exceeds a predetermined value; and another valve member movable in said housing assembly responsive to opening of said pilot valve and to abnormal increase in pressure drop across said orifice means to open a relief passage from said high pressure zone to said low pressure zone; and another orifice means limiting the pressure drop across said orifice means during normal operation of said valve and pilot valve members so that said another valve member is retained in position closing said relief passage except when there is an abnormal increase in pressure drop across said orifice means due to rapid rise of fluid pressure in said high pressure zone.

22. The control means of claim 21 wherein said another valve member has opposed areas respectively exposed to said high pressure zone and to said high pressure zone between said orifice means and said another orifice means.

23. The control means of claim 21 wherein said another valve member has unequal opposed areas of which the smaller area is exposed to said high pressure zone and of which the larger area is exposed to said high pressure zone between said orifice means and said another orifice means.

24. The control means of claim 23 wherein spring means acting on said another valve member assists the fluid pressure acting on said smaller area in moving said another valve member to open said relief passage as aforesaid.

* * * * *